US010971052B2

(12) United States Patent
Song

(10) Patent No.: US 10,971,052 B2
(45) Date of Patent: Apr. 6, 2021

(54) DRIVING METHOD AND DRIVING DEVICE FOR DISPLAY PANEL, AND DISPLAY DEVICE

(71) Applicant: BOE Technology Group Co., Ltd., Beijing (CN)

(72) Inventor: Danna Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 46 days.

(21) Appl. No.: 16/466,139

(22) PCT Filed: Sep. 27, 2018

(86) PCT No.: PCT/CN2018/107967
§ 371 (c)(1),
(2) Date: Jun. 3, 2019

(87) PCT Pub. No.: WO2019/091243
PCT Pub. Date: May 16, 2019

(65) Prior Publication Data

US 2020/0066199 A1 Feb. 27, 2020

(30) Foreign Application Priority Data

Nov. 10, 2017 (CN) ..... 201711103049.X

(51) Int. Cl.
*G09G 3/20* (2006.01)
*G09G 3/3275* (2016.01)

(52) U.S. Cl.
CPC ..... *G09G 3/2003* (2013.01); *G09G 3/3275* (2013.01); *G09G 2300/0452* (2013.01);
(Continued)

(58) Field of Classification Search
CPC ..... G09G 3/2003; G09G 3/3275; G09G 2300/0452; G09G 2320/0242;
(Continued)

(56) References Cited

U.S. PATENT DOCUMENTS

2008/0150971 A1* 6/2008 Kienhoefer ..... G09G 3/22 345/690
2011/0148906 A1 6/2011 Jeong et al.
(Continued)

FOREIGN PATENT DOCUMENTS

CN 102103828 A 6/2011
CN 102292757 A 12/2011
(Continued)

OTHER PUBLICATIONS

First office action of Chinese application No. 201711103049.X dated Mar. 18, 2020.

*Primary Examiner* — Mark Edwards
(74) *Attorney, Agent, or Firm* — Fay Sharpe LLP

(57) ABSTRACT

A driving method and a driving device for a display panel, and a display device are provided. Each pixel of the display panel includes at least two primary-color sub-pixels of different colors and one mixed-color sub-pixel, and the driving method comprises: determining display power consumption according to the obtained brightness value of each of the primary-color sub-pixels; compensating for the brightness value of each of the primary-color sub-pixels according to the display power consumption; determining an output brightness value of each of the sub-pixels according to the compensated brightness value of each of the primary-color sub-pixels and a color coordinate of each of the sub-pixels; and outputting the output brightness value of each of the sub-pixels to a source driving circuit.

18 Claims, 10 Drawing Sheets

(52) U.S. Cl.
CPC ..... *G09G 2320/0242* (2013.01); *G09G 2320/045* (2013.01); *G09G 2320/0626* (2013.01); *G09G 2320/103* (2013.01); *G09G 2330/023* (2013.01); *G09G 2360/16* (2013.01)

(58) Field of Classification Search
CPC ..... G09G 2320/045; G09G 2320/0626; G09G 2320/103; G09G 2330/023; G09G 2360/16
USPC ..... 345/694
See application file for complete search history.

(56) References Cited

U.S. PATENT DOCUMENTS

2011/0298818 A1* 12/2011 Mori ..... G09G 3/3208 345/589
2014/0307170 A1 10/2014 Mori
2016/0125622 A1* 5/2016 Kim ..... G06T 5/009 345/690
2016/0253942 A1* 9/2016 Tseng ..... G09G 3/2003 345/601
2016/0307493 A1 10/2016 Song et al.
2017/0098429 A1 4/2017 Sullivan et al.
2018/0033397 A1* 2/2018 Huang ..... G09G 3/3208
2018/0082660 A1* 3/2018 Xu ..... G09G 3/3208
2018/0322829 A1* 11/2018 Xie ..... G09G 3/3233

FOREIGN PATENT DOCUMENTS

CN 102693701 A 9/2012
CN 104299568 A 1/2015
CN 105528994 A 4/2016
CN 106448570 A 2/2017
KR 20160082425 A 7/2016

* cited by examiner

DRIVING METHOD AND DRIVING DEVICE FOR DISPLAY PANEL, AND DISPLAY DEVICE

CROSS-REFERENCE TO RELATED APPLICATION

This disclosure is a 371 of PCT Patent Application Ser. No. PCT/CN2018/107967, filed on Sep. 27, 2018, which claims priority to Chinese Patent Application No. 201711103049.X, filed on Nov. 10, 2017 and entitled "DRIVING METHOD AND DRIVING DEVICE FOR DISPLAY PANEL, AND DISPLAY DEVICE", the entire contents of which are incorporated herein by reference.

TECHNICAL FIELD

The present disclosure relates to a driving method and a driving device for a display panel, and a display device.

BACKGROUND

In order to improve the display effect, organic light-emitting diode (OLED) display panels usually begin to adopt four-color sub-pixels. For example, each pixel of the display panel includes a red (R) sub-pixel for generating red light, a green (G) sub-pixel for generating green light, a blue (B) sub-pixel for generating blue light, and a white (W) sub-pixel for generating white light. Among them, R, G, B sub-pixels are generally referred to as primary-color sub-pixels, and W sub-pixel is generally referred to as a mixed-color sub-pixel.

Since the image signal transmission interface in the driving device for the display panel generally only supports RGB data signals, the driving device can convert the received RGB data signals into the RGBW data signals and then output to the source driving circuit when driving the OLED display panel having the RGBW four-color sub-pixels.

SUMMARY

The present disclosure provides a driving method and a driving device for a display panel, and a display device. The technical solutions are as follows:

According to an aspect of the present disclosure, there is provided a driving method for a display panel, wherein each pixel of the display panel comprises at least two primary-color sub-pixels of different colors and one mixed-color sub-pixel, and the driving method comprises: determining display power consumption according to the obtained brightness value of each of the primary-color sub-pixels; compensating for the brightness value of each of the primary-color sub-pixels according to the display power consumption; determining an output brightness value of each of the sub-pixels according to the compensated brightness value of each of the primary-color sub-pixels and a color coordinate of each of the sub-pixels; and outputting the output brightness value of each of the sub-pixels to a source driving circuit, wherein the output brightness value of each of the sub-pixels are used by the source driving circuit to drive the display panel to display images.

Optionally, compensating for the brightness value of each of the primary-color sub-pixels according to the display power consumption comprises: determining a power consumption gain according to the display power consumption, wherein the power consumption gain is negatively correlated with the display power consumption; and making compensation for the brightness value of each of the primary-color sub-pixels by using the power consumption gain.

Optionally, after making the compensation for the brightness value of each of the primary-color sub-pixels by using the power consumption gain, the driving method further comprises: detecting whether a display image is a still image; determining, if it is detected that the display image is a still image, a static gain according to the power consumption gain and a still duration of the still image, wherein the static gain is negatively correlated with the power consumption gain, and is negatively correlated with the still duration; and making compensation for the brightness value of each of the primary-color sub-pixels by using the static gain after the compensation using the power consumption gain.

Optionally, detecting whether the display image is a still image comprises: adding the brightness value of each of the primary-color sub-pixels in all pixels in the display image to obtain a sum of brightness of the display image; determining that the display image is a still image if the sum of brightness of the display image is equal to a sum of brightness of a previous frame image; and determining that the display image is not a still image if the sum of the brightness of the display image is not equal to the sum of brightness of the previous frame image.

Optionally, determining the output brightness value of each of the sub-pixels according to the compensated brightness value of each of the primary-color sub-pixels and the color coordinate of each of the sub-pixels comprises: determining a color mixing ratio corresponding to each of the primary-color sub-pixels according to the color coordinate of each of the primary-color sub-pixels and the color coordinate of the mixed-color sub-pixel, wherein the color mixing ratio corresponding to each of the primary-color sub-pixels refers to the proportion of light having a color of the primary-color sub-pixel in light emitted by the mixed-color sub-pixel; calculating a ratio of the compensated brightness value of each of the primary-color sub-pixels to the color mixing ratio of the primary-color sub-pixel, to obtain a reference brightness value corresponding to each of the primary-color sub-pixels; determining the minimum reference brightness value among the reference brightness values corresponding to the primary-color sub-pixels as an output brightness value of the mixed-color sub-pixel; and determining an output brightness value of each of the primary-color sub-pixels according to the output brightness value of the mixed-color sub-pixel, wherein the output brightness value of each of the primary-color sub-pixels is a difference between the compensated brightness value of the primary-color sub-pixel and the brightness component of the primary-color sub-pixel, wherein the brightness component of the primary-color sub-pixel is a product of the output brightness value of the mixed-color sub-pixel and the color mixing ratio corresponding to the primary-color sub-pixel.

Optionally, the driving method further comprises: determining a brightness value of each of the primary-color sub-pixels at a highest gray level according to a color coordinate of a target mixed-color light, a brightness value of the target mixed-color light at the highest gray level, and the color coordinate of the mixed-color sub-pixel; determining a brightness value of the mixed-color sub-pixel at the highest gray level according to the brightness value of each of the primary-color sub-pixels at the highest gray level and a color mixing ratio corresponding to each of the primary-color sub-pixels, wherein the color mixing ratio corresponding to each of the primary-color sub-pixels refers to the proportion of light having a color of the primary-color sub-pixel in light emitted by the mixed-color sub-pixel; and determining a correspondence relationship between a gray level and a brightness value of each of the sub-pixels according to the brightness value of each of the sub-pixels at the highest gray level and a gamma value;

before determining the display power consumption according to the obtained brightness value of each of the primary-color sub-pixels, the driving method further comprises: receiving a display gray level of each of the primary-color sub-pixels; and determining the brightness value corresponding to the display gray level of each of the primary-color sub-pixels according to the correspondence relationship between the gray level and the brightness value of each of the sub-pixels.

Optionally, outputting the output brightness value of each of the sub-pixels to the source driving circuit comprises: determining an aging compensation coefficient of the display panel according to a current driving efficiency of the display panel, wherein the aging compensation coefficient is negatively correlated with the driving efficiency; and compensating for the output brightness value of each of the sub-pixels by using the aging compensation coefficient, and outputting the compensated output brightness value of each of the sub-pixels to the source driving circuit.

Optionally, outputting the output brightness value of each of the sub-pixels to the source driving circuit comprises: determining a driving compensation coefficient of a driving transistor in the display panel; and compensating for the output brightness value of each of the sub-pixels by using the driving compensation coefficient, and output the compensated output brightness value of each of the sub-pixels to the source driving circuit.

Optionally, the display power consumption S satisfies:

$$S = \sum_{i=1}^{n} Li - (n-1)\min(L1, \ldots, Ln);$$

wherein n is the total number of primary-color sub-pixels included in each pixel, Li is the brightness value of the i-th primary-color sub-pixel, i is a positive integer not greater than n, and min represents to get a minimum value.

According to another aspect of the present disclosure, there is provided a driving device for a display panel, wherein each pixel of the display panel comprises at least two primary-color sub-pixels of different colors and one mixed-color sub-pixel, and the driving device comprises: a processor, a memory, and a computer program stored on the memory and capable of running on the processor, wherein the processor implements following process when executing the computer program: determining display power consumption according to the obtained brightness value of each of the primary-color sub-pixels; compensating for the brightness value of each of the primary-color sub-pixels according to the display power consumption; determining an output brightness value of each of the sub-pixels according to the compensated brightness value of each of the primary-color sub-pixels and a color coordinate of each of the sub-pixels; and outputting the output brightness value of each of the sub-pixels to a source driving circuit, wherein the output brightness value of each of the sub-pixels are used by the source driving circuit to drive the display panel to display images.

Optionally, compensating for the brightness value of each of the primary-color sub-pixels according to the display power consumption comprises: determining a power consumption gain according to the display power consumption, wherein the power consumption gain is negatively correlated with the display power consumption; and making compensation for the brightness value of each of the primary-color sub-pixels by using the power consumption gain.

Optionally, the processor further implements following process when executing the computer program: detecting whether a display image is a still image; determining, if it is detected that the display image is a still image, a static gain according to the power consumption gain and a still duration of the still image, wherein the static gain is negatively correlated with the power consumption gain, and is negatively correlated with the still duration; and making compensation for the brightness value of each of the primary-color sub-pixels by using the static gain after the compensation using the power consumption gain.

Optionally, detecting whether a display image is a still image comprises: adding the brightness value of each of the primary-color sub-pixels in all pixels in the display image to obtain a sum of brightness of the display image; determining that the display image is a still image if the sum of brightness of the display image is equal to a sum of brightness of a previous frame image; and determining that the display image is not a still image if the sum of the brightness of the display image is not equal to the sum of the brightness of the previous frame image.

Optionally, determining the output brightness value of each of the sub-pixels according to the compensated brightness value of each of the primary-color sub-pixels and the color coordinate of each of the sub-pixels comprises: determining a color mixing ratio corresponding to each of the primary-color sub-pixels according to the color coordinate of each of the primary-color sub-pixels and the color coordinate of the mixed-color sub-pixel, wherein the color mixing ratio corresponding to each of the primary-color sub-pixels refers to the proportion of light having a color of the primary-color sub-pixel in light emitted by the mixed-color sub-pixel; calculating a ratio of the compensated brightness value of each of the primary-color sub-pixels to the color mixing ratio of the primary-color sub-pixel, to obtain a reference brightness value corresponding to each of the primary-color sub-pixels; determining the minimum reference brightness value among the reference brightness values corresponding to the primary-color sub-pixels as an output brightness value of the mixed-color sub-pixel; and determining an output brightness value of each of the primary-color sub-pixels according to the output brightness value of the mixed-color sub-pixel, wherein the output brightness value of each of the primary-color sub-pixels is a difference between the compensated brightness value of the primary-color sub-pixel and the brightness component of the primary-color sub-pixel, wherein the brightness component of the primary-color sub-pixel is a product of the output brightness value of the mixed-color sub-pixel and the color mixing ratio corresponding to the primary-color sub-pixel.

Optionally, the processor further implements following process when executing the computer program: determining a brightness value of each of the primary-color sub-pixels at a highest gray level according to a color coordinate of a target mixed-color light, a brightness value of the target mixed-color light at the highest gray level, and the color coordinate of the mixed-color sub-pixel; determining a brightness value of the mixed-color sub-pixel at the highest gray level according to the brightness value of each of the primary-color sub-pixels at the highest gray level and a color mixing ratio corresponding to each of the primary-color sub-pixels, wherein the color mixing ratio corresponding to each of the primary-color sub-pixels refers to the proportion of light having a color of the primary-color sub-pixel in light emitted by the mixed-color sub-pixel; and determining a correspondence relationship between a gray level and a brightness value of each of the sub-pixels according to the brightness value of each of the sub-pixels at the highest gray level and a gamma value; the processor further implements following process when executing the computer program: receiving a display gray level of each of the primary-color sub-pixels; and determining the brightness value corresponding to the display gray level of each of the primary-color sub-pixels according to the correspondence relationship between the gray level and the brightness value of each of the sub-pixels.

Optionally, outputting the output brightness value of each of the sub-pixels to the source driving circuit comprises: determining an aging compensation coefficient of the display panel according to a current driving efficiency of the display panel, wherein the aging compensation coefficient is negatively correlated with the driving efficiency; and compensating for the output brightness value of each of the sub-pixels by using the aging compensation coefficient, and outputting the compensated output brightness value of each of the sub-pixels to the source driving circuit.

Optionally, outputting the output brightness value of each of the sub-pixels to the source driving circuit comprises: determining a driving compensation coefficient of a driving transistor in the display panel; and compensating for the output brightness value of each of the sub-pixels by using the driving compensation coefficient, and output the compensated output brightness value of each of the sub-pixels to the source driving circuit.

Optionally, the display power consumption S satisfies:

$$S = \sum_{i=1}^{n} Li - (n-1)\min(L1, \ldots, Ln);$$

wherein n is the total number of primary-color sub-pixels included in each pixel, Li is the brightness value of the i-th primary-color sub-pixel, i is a positive integer not greater than n, and min represents to get a minimum value.

According to still another aspect of the present disclosure, there is provided a display device comprising: a display panel, and the driving device for the display panel as described in the above aspect.

According to yet another aspect of the present disclosure, there is provided A computer readable storage medium having instructions stored therein, wherein the stored computer program is capable of implementing the driving method for the display panel as described in the above aspect when running on a computer.

DETAILED DESCRIPTION

The embodiments of the present disclosure will be described in further detail with reference to the accompanying drawings, to clearly present the principles and advantages of the present disclosure.

In the OLED display panel according to an embodiment of the present disclosure, each pixel may include at least two primary-color sub-pixels of different colors and one mixed-color sub-pixel. For example, three primary-color sub-pixels of different colors of R, G, and B, and one white mixed-color sub-pixel may be included. An organic light-emitting diode capable of emitting white light and a color film of a corresponding color may be included in each of the primary-color sub-pixels, and there is no need to provide a color film in the mixed-color sub-pixel. Since the transmittance of the color film is low, in order to ensure the display brightness, it is generally necessary to increase the current passing through the organic light-emitting diode in each of the primary-color sub-pixels, which increases the power consumption of the display panel. Moreover, since the light emitted by the primary-color sub-pixels can generate the light emitted by the mixed-color sub-pixel after being mixed in a certain ratio, by driving the mixed-color sub-pixel to emit light, a part of the light emitted by each of the primary-color sub-pixels may be replaced. Since the transmittance of the mixed-color sub-pixel is much higher than the transmittance of each of the primary-color sub-pixels, the display power consumption can be greatly reduced under the same brightness requirement.

Figure 1:
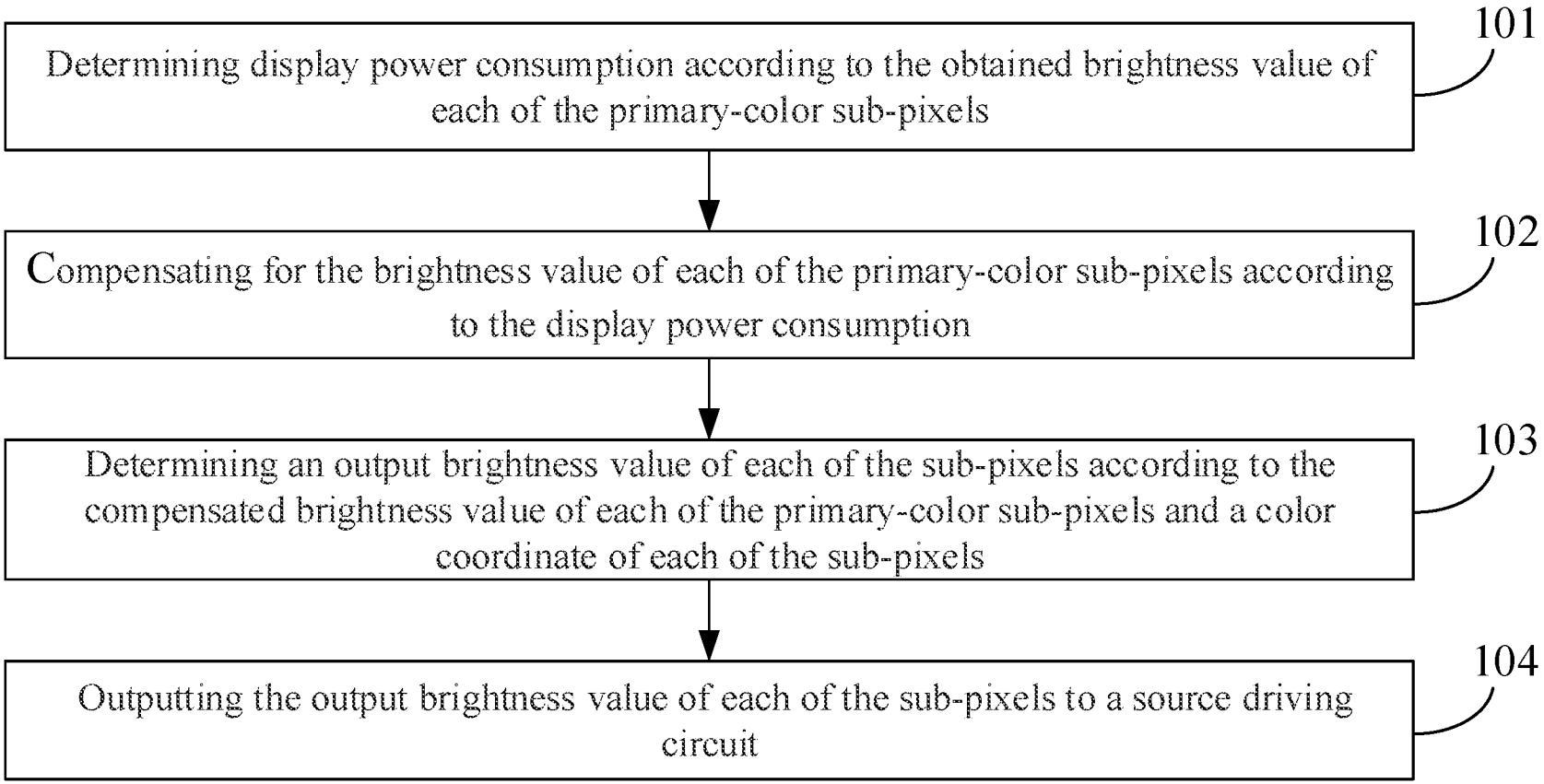
FIG. 1 is a flowchart of a driving method for a display panel according to an embodiment of the present disclosure.

FIG. 1 is a flowchart of a driving method for a display panel according to an embodiment of the present disclosure. The driving method may be applied to a driving device for a display device, and each pixel of the display panel may comprise at least two primary-color sub-pixels of different colors and one mixed-color sub-pixel.

Referring to FIG. 1, the driving method may comprise step 101 to step 104.

In step 101, display power consumption is determined according to the obtained brightness value of each of the primary-color sub-pixels.

In the embodiment of the present disclosure, the display power consumption is positively correlated with the brightness value of each of the primary-color sub-pixels. That is, the greater the brightness value of each of the primary-color sub-pixels is, the greater the display power consumption is.

In step 102, the brightness value of each of the primary-color sub-pixels is compensated according to the display power consumption.

The driving device may calculate a power consumption gain according to the display power consumption, and compensate for the brightness value of each of the primary-color sub-pixels according to the power consumption gain. The power consumption gain may be negatively correlated with the display power consumption. That is, the greater the display power consumption is, the smaller the power consumption gain is. Thus, it can be ensured that when the display power consumption of the display device is small, the compensation for the brightness value is increased to improve the display effect, and that when the display power consumption of the display device is large, the compensation for the brightness value is reduced to avoid excessive display power consumption.

In step 103, an output brightness value of each of the sub-pixels is determined according to the compensated brightness value of each of the primary-color sub-pixels and the color coordinate of each of the sub-pixels.

The driving device may determine an output brightness value of the mixed-color sub-pixel and an output brightness value of each of the primary-color sub-pixels according to the compensated brightness value of each of the primary-color sub-pixels and the color coordinate of each of the sub-pixels in the primary-color sub-pixels and the mixed-color sub-pixel. That is, the conversion of the RGB brightness values into the RGBW brightness values can be achieved. The color coordinate, that is, the coordinate of the color, is usually expressed by (x, y, z), wherein x represents the ratio of red light in white light, and y represents the ratio of green light in white light. z is generally not represented and may be calculated by the formula l-x-y, and thus the color coordinate may also be expressed by (x, y).

In step 104, the output brightness value of each of the sub-pixels is outputted to a source driving circuit.

The driving device may output the compensated and converted output brightness value of each of the sub-pixels to the source driving circuit, so that the source driving circuit drives the display panel to display images according to the converted output brightness value of each of the sub-pixels.

Exemplarily, the driving device may directly output the output brightness value of each of the sub-pixels to the source driving circuit; or the driving device may convert the output brightness value of each of the sub-pixels into display gray levels and then output to the source driving circuit.

In summary, with respect to the driving method according to the embodiment of the present disclosure, the brightness value of each of the primary-color sub-pixels may be compensated according to the display power consumption after the brightness value of each of the primary-color sub-pixels is obtained, so that when the display power consumption is different, the degree of compensation for the brightness value is also different, and thus the power consumption of the display device can be reasonably utilized to improve the driving flexibility and the display effect of the display panel.

Figure 2:
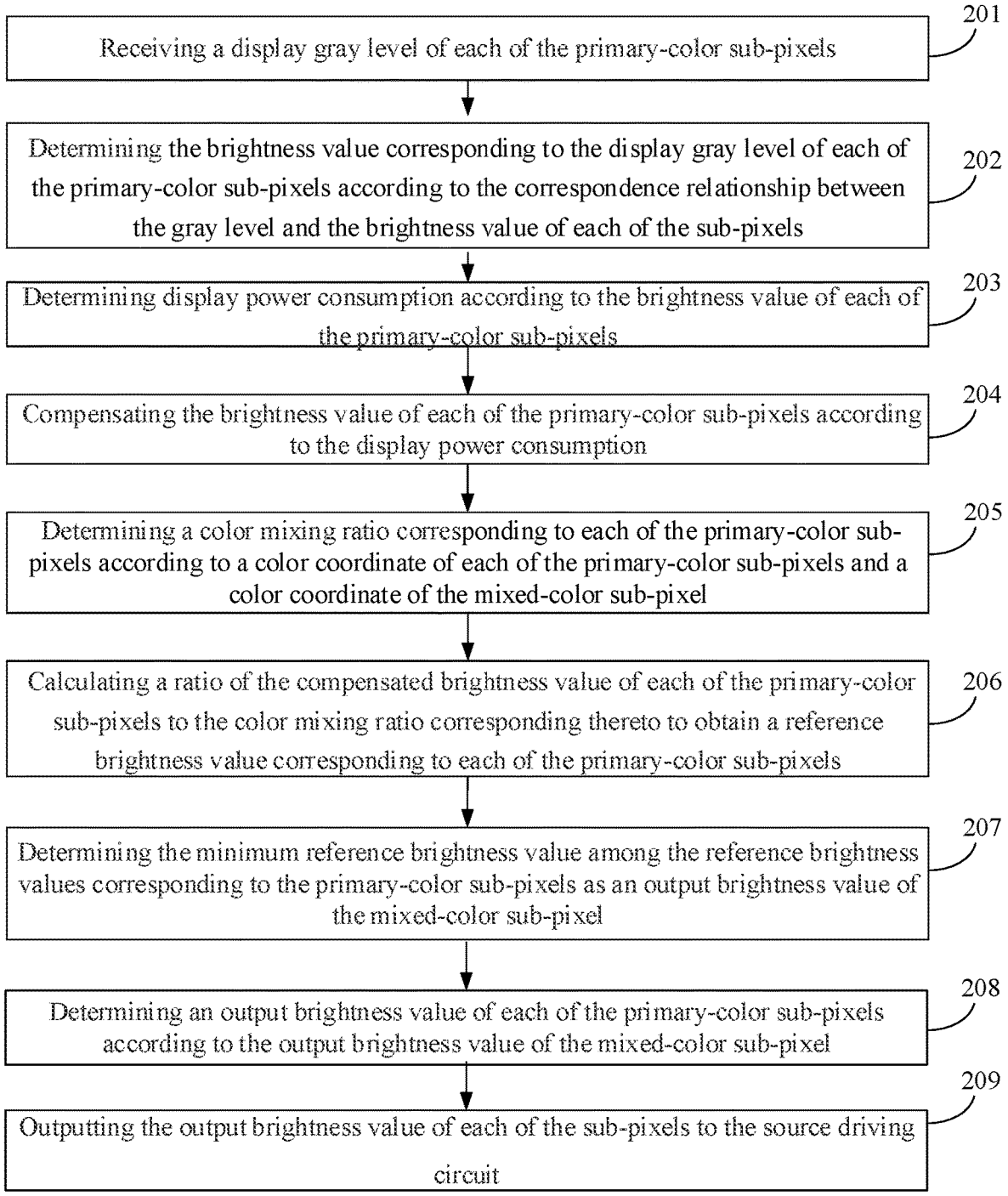
FIG. 2 is a flowchart of another driving method for a display panel according to an embodiment of the present disclosure.

FIG. 2 is a flowchart of another driving method for a display panel according to an embodiment of the present disclosure. The driving method may be applied to a driving device for a display device, and each pixel of the display panel may comprise at least two primary-color sub-pixels of different colors and one mixed-color sub-pixel.

Referring to FIG. 2, the driving method may comprise step 201 to step 209.

In step 201, a display gray level of each of the primary-color sub-pixels is received.

In the embodiment of the present disclosure, the driving device may receive a display gray level of each of the primary-color sub-pixels in each pixel transmitted by a signal source.

In step 202, the brightness value corresponding to the display gray level of each of the primary-color sub-pixels is determined according to the correspondence relationship between the gray level and the brightness value of each of the sub-pixels.

The driving device may convert the display gray level into the brightness value according to a preset correspondence relationship between the gray level and the brightness value. For example, the correspondence relationship between the gray level and the brightness value may be a gamma curve, and the gamma curve may be used to represent the display brightness of the sub-pixels of different colors under different gray levels. At present, the commonly used gamma curve is generally a gamma curve 2.2. That is, the brightness value of each of the primary-color sub-pixels is the 2.2th power of the gray level.

In step 203, display power consumption is determined according to the brightness value of each of the primary-color sub-pixels.

The display power consumption is positively correlated with the brightness value of each of the primary-color sub-pixels. That is, the greater the brightness value of each of the primary-color sub-pixels is, the greater the display power consumption is. In the embodiment of the present disclosure, the display power consumption S may satisfy:

$$S = \sum_{i=1}^{n} Li + \min(L1, \ldots, Ln) - n \times \min(L1, \ldots, Ln) = \sum_{i=1}^{n} Li - (n-1) \times \min(L1, \ldots, Ln); \quad \text{Formula (1)}$$

wherein n is the total number of primary-color sub-pixels included in each pixel, Li is the brightness value of the i-th primary-color sub-pixel, and i is a positive integer not greater than n. min (L1, . . . , Ln) represents the minimum value among the brightness values of each of the primary-color sub-pixels, and the minimum value can be used as the brightness value of the mixed-color sub-pixel when the mixed-color sub-pixel emits light. As can be seen from the above Formula (1), the display power consumption S is a difference between a sum of the brightness value of each of the primacy-color sub-pixels and (n−1) times the minimum value among the brightness values of each of the primary-color sub-pixels. Since the mixed-color sub-pixel can emit light instead of each of the primary-color sub-pixels, the power consumption generated when the mixed-color sub-pixel emits light can offset the power consumption generated when each of the primary-color sub-pixels emits light. Therefore, upon calculating the display power consumption, it is necessary to subtract n times the minimum brightness of each of the primary-color sub-pixels from the sum of the brightness of each of the sub-pixels, and the sub-pixels include each of the primary-color sub-pixels and the mixed-color sub-pixel.

Exemplarily, it is assumed that each pixel in the display panel includes primary-color sub-pixels of three colors of R, G, and B (i.e., n=3) and one W mixed-color sub-pixel, and the brightness values of three primary-color sub-pixels in one pixel are: LR, LG, and LB, respectively. Then, according to the above Formula (1), it can be determined that the current display power consumption of the pixel in the display panel is: S=LR+LG+LB−2×min (LR, LG, LB).

In step 204, the brightness value of each of the primary-color sub-pixels is compensated according to the display power consumption.

Figure 3:
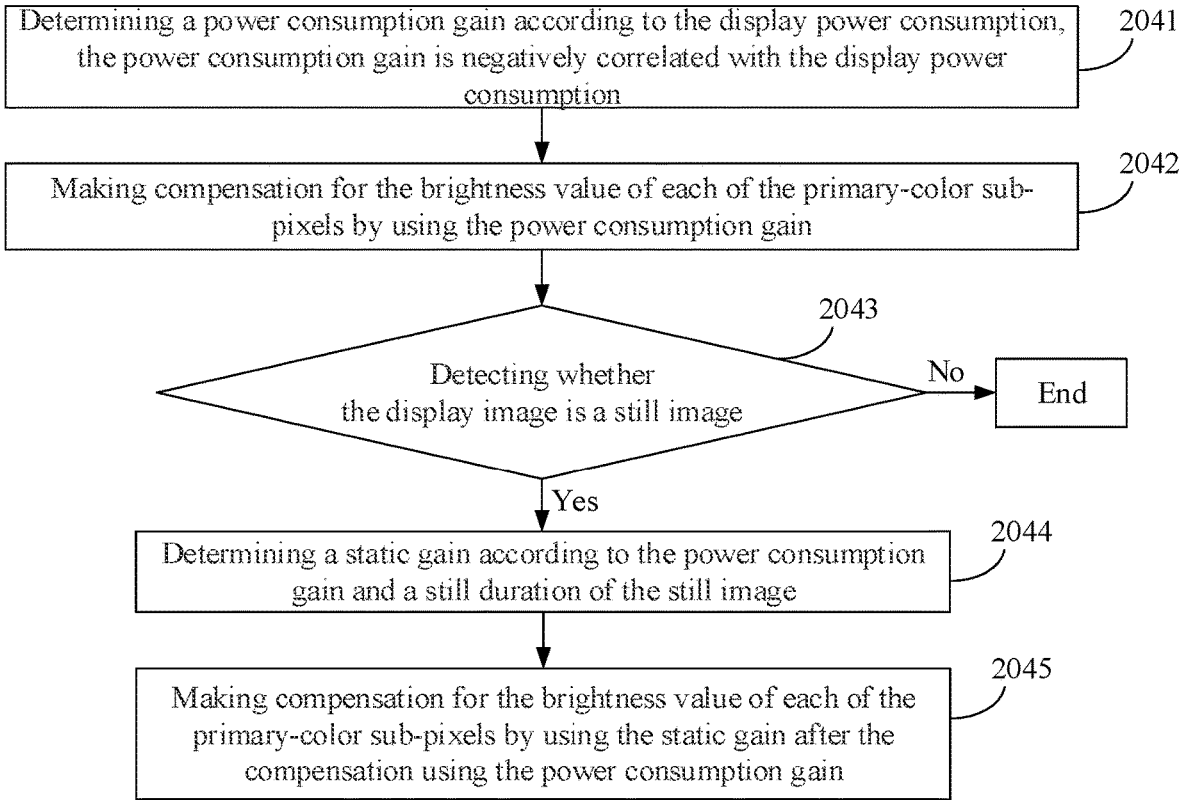
FIG. 3 is a flowchart of a method for compensating for a brightness value of each of the primary-color sub-pixels according to display power consumption according to an embodiment of the present disclosure.

FIG. 3 is a flowchart of a method for compensating for a brightness value of each of the primary-color sub-pixels according to display power consumption according to an embodiment of the present disclosure.

Referring to FIG. 3, the compensation method may include step 2041 to step 2045.

In step 2041, a power consumption gain is determined according to the display power consumption, and the power consumption gain is negatively correlated with the display power consumption.

In the embodiment of the present disclosure, the power consumption gain P may be negatively correlated with the display power consumption. That is, the greater the display power consumption is, the smaller the power consumption gain P is. The power consumption gain P may be a number greater than 0 and less than or equal to 1. The power consumption gain P may be 1 when the display power consumption is less than or equal to a preset minimum power consumption threshold. Thus, it can be ensured that when the display power consumption is small, the power consumption gain P is large, and the compensation for the brightness value is increased to improve the display effect, and that when the display power consumption is large, the power consumption gain P is small, and the compensation for the brightness value may be reduced to avoid excessive display power consumption.

Exemplarily, it is assumed that a correspondence relationship between a power consumption range and the power consumption gain P is stored in the driving device. Then, after calculating the display power consumption, according to the power consumption range in which the display power consumption is, the driving device may determine the power consumption gain P corresponding thereto.

In step 2042, compensation is made for the brightness value of each of the primary-color sub-pixels by using the power consumption gain.

The driving device may make compensation for the brightness value of each of the primary-color sub-pixels according to the determined power consumption gain. For example, the brightness value after the compensation using the power consumption gain may be obtained by multiplying the brightness value of each of the primary-color sub-pixels by the power consumption gain. Since the power consumption gain is negatively correlated with the display power consumption, the greater the display power consumption is, the smaller the compensated brightness value of each of the primary-color sub-pixels is, which can effectively reduce the power consumption of the display panel. Correspondingly, the lower the display power consumption is, the greater the compensated brightness value of each of the primary-color sub-pixels is, which can effectively improve the display effect in a low power consumption scenario.

Exemplarily, it is assumed that the power consumption gain P is 0.8, the brightness values of the primary-color sub-pixels of three colors of R, G, and B after the compensation using the power consumption gain may be 0.8×LR, 0.8×LG, and 0.8×LB, respectively.

In step 2043, it is detected whether the display image is a still image.

If it is detected that the display image is a still image, step 2044 may be performed. If it is detected that the display image is not a still image, the operation may be ended. That is, compensation using static gain is no longer made, and the subsequent step, i.e., step 205, is directly performed.

In the embodiment of the present disclosure, the still image may refer to an image, the image content of which is the same as the image content of the previous frame display image. The driving device may add the brightness value of each of the primary-color sub-pixels in all pixels in the display image to be displayed, and when the sum of the brightness is equal to the sum of the brightness of the previous frame image, it may be determined that the display image to be displayed is a still image. Or, the driving device may also add the display gray level of each of the primary-color sub-pixels, and when the sum of the gray level is equal to the sum of the gray level of the previous frame image, it may be determined that the display image to be displayed is a still image. There are a number of methods for detecting whether the display image is a still image or not, which is not limit in the embodiment of the present disclosure.

In step 2044, a static gain is determined according to the power consumption gain and a still duration of the still image.

When the driving device detects that the display image is a still image, the still duration of the still image may be recorded by using a timer, and the static gain may be determined according to the predetermined power consumption gain and the recorded still duration. The still duration may refer to the duration between when it is detected that the display image is a still image and when the next non-still image of a frame is detected. The static gain may be negatively correlated with the power consumption gain and be negatively correlated with the still duration. And the static gain is also a number greater than 0 and less than or equal to 1. Since the display image is a still image, an afterimage may appear in the still image, which affects the display effect, and the longer the still duration is, the more severe the afterimage is, and the greater the affect on the display effect is. Therefore, in the embodiment of the present disclosure, the brightness value of each of the primary-color sub-pixels may be further compensated according to the power consumption gain of the display panel and the still duration of the still image.

Exemplarily, in the embodiment of the present disclosure, the static gain K may be expressed as: K=f(P, t). That is, the static gain K may be a function related to the power consumption gain P and the still duration t. For example, the initial value of the static gain K may be 1, and may gradually decrease as the still duration t increases. Moreover, the larger the power consumption gain P is, the faster the static gain K changes with the still duration t.

In step 2045, compensation for the brightness value of each of the primary color sub-pixels after the compensation is made by using the static gain.

After the driving device determines the static gain, compensation for the brightness value of each of the primary-color sub-pixels after the compensation using the power consumption gain may be made by using the static gain, so as to prevent the afterimage formed in the still image from affecting the display effect, which ensures the stability of the image display. Alternatively, when the driving device compensates for the brightness value by using the static gain, the static gain may be multiplied by the brightness value of each of the primary-color sub-pixels after the compensation using the power consumption gain.

Exemplarily, it is assumed that the static gain K determined by the driving device according to the power consumption gain P and the still duration t is 0.9, and the brightness values of the primary-color sub-pixels of three colors of R, G, and B after the compensation using the power consumption gain and the compensation using the static gain may be: LR2=0.9×0.8×LR, LG2=0.9×0.8×LG, LB2=0.9×0.8×LB, respectively.

Alternatively, in the embodiment of the present disclosure, the step of compensation shown in the above steps 2043 to 2045 may also be deleted according to the situation. That is, the driving device may also only make compensation using the power consumption gain for the brightness value of each of the primary-color sub-pixels.

In step 205, a color mixing ratio corresponding to each of the primary-color sub-pixels is determined according to a color coordinate of each of the primary-color sub-pixels and a color coordinate of the mixed-color sub-pixel.

The color mixing ratio corresponding to each of the primary-color sub-pixels refers to the proportion of the light having a color of the primary-color sub-pixels in the light emitted by the mixed-color sub-pixel. In the embodiment of the present disclosure, the display panel may be previously driven to display a monochrome image, and the color coordinate of each of the primary-color sub-pixels and the color coordinate of the mixed-color sub-pixel are actually measured by a color coordinate measuring device, and thus the color mixing ratio corresponding to each of the primary-color sub-pixels in the mixed-color sub-pixel may be calculated. The color mixing ratio of each of the primary-color sub-pixels is a number greater than or equal to 0 and less than or equal to 1. For example, upon determining the color mixing ratio corresponding to the red sub-pixel R, the color coordinate (x1, y1) of the red sub-pixel R and the color coordinate (x0, y0) of the mixed-color sub-pixel may be actually measured, and the proportion of red light having a color of the red sub-pixels in the light emitted by the mixed-color sub-pixel may be derived according to the two measured color coordinates.

Figure 4:
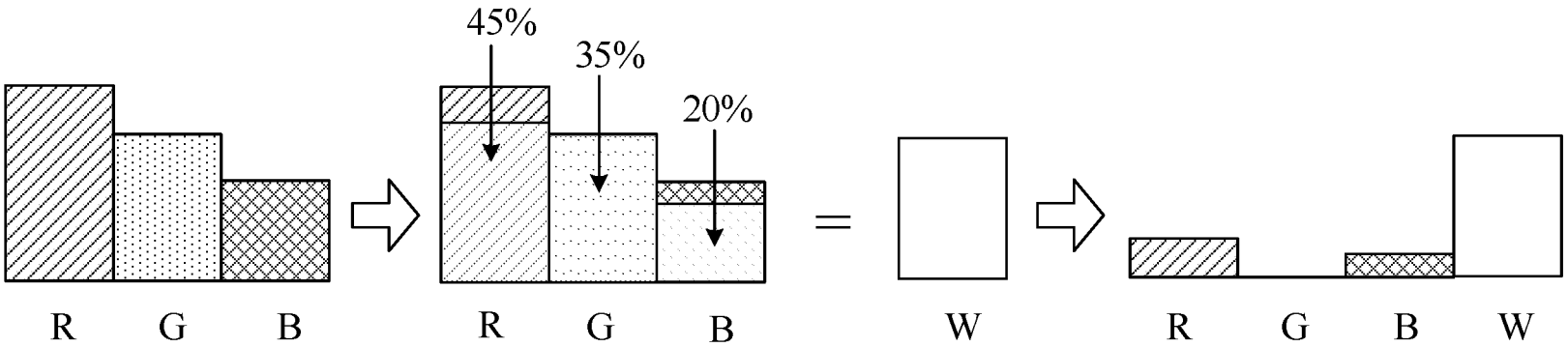
FIG. 4 is a schematic diagram for determining an output brightness value of the mixed-color sub-pixel according to a color mixing ratio of each of the primary-color sub-pixels according to an embodiment of the present disclosure.

Exemplarily, it is assumed that each pixel includes primary-color sub-pixels of three colors of R, G, and B. As shown in FIG. 4, the driving device calculates that the color mixing ratio Rs of the red sub-pixel R may be Rs=45%, the color mixing ratio Gs of the green sub-pixel G may be Gs=35%, and the color mixing ratio Bs of the blue sub-pixel B may be Bs=20%. That is, 45% of red light, 35% of green light, and 20% of blue light may be included in the light emitted by the white mixed-color sub-pixel W.

In step 206, a ratio of the compensated brightness value of each of the primary-color sub-pixels to the color mixing ratio corresponding thereto is calculated to obtain a reference brightness value corresponding to each of the primary-color sub-pixels.

The reference brightness value corresponding to each of the primary-color sub-pixels is a ratio of the compensated brightness value of the primary-color sub-pixel to the color mixing ratio corresponding to the primary-color sub-pixel.

Exemplarily, it is assumed that the compensated brightness values of the primary-color sub-pixels of three colors of R, G, and B are LR2, LG2, and LB2, respectively, and the color mixing ratios thereof are: Rs, Gs, and Bs, respectively. Then, the driving device can calculate that the reference brightness value corresponding to the primary-color sub-pixel R is LR2/Rs, the reference brightness value corresponding to the primary-color sub-pixel G is LG2/Gs, and the reference brightness value corresponding to the primary-color sub-pixel B is LB2/Bs.

In step 207, the minimum reference brightness value among the reference brightness values corresponding to the primary-color sub-pixels is determined as an output brightness value of the mixed-color sub-pixel.

The driving device may compare the size of the reference brightness values corresponding to the primary-color sub-pixels, and determine the minimum reference brightness value as the output brightness value of the mixed-color sub-pixel, so that the mixed-color sub-pixel can replace the primary-color sub-pixel corresponding to the minimum reference brightness value to emit light.

Exemplarily, it is assumed that among the reference brightness values corresponding to the primary-color sub-pixels of three colors of R, G, and B, the reference brightness value LG2/Gs corresponding to the green sub-pixel G is minimum. Thus, the driving device may determine the reference brightness value LG2/Gs as the output brightness value of the white mixed-color sub-pixel W, so that the white mixed-color sub-pixel W can replace the green sub-pixel G to emit light.

In step 208, an output brightness value of each of the primary-color sub-pixels is determined according to the output brightness value of the mixed-color sub-pixel.

The output brightness value of each of the primary-color sub-pixels is a difference between the compensated brightness value of the primary-color sub-pixel and the brightness component of the primary-color sub-pixel. The brightness component of each of the primary-color sub-pixels is a product of the output brightness value of the mixed-color sub-pixel and the color mixing ratio corresponding to the primary-color sub-pixel. It can be known that the brightness component of the primary-color sub-pixel corresponding to the minimum reference brightness value is the compensated brightness value of the primary-color sub-pixel, and thus the output brightness value of the primary-color sub-pixel corresponding to the minimum reference brightness value is 0. Correspondingly, when the pixels in the display panel emit light, the mixed-color sub-pixel can emit light instead of the primary-color sub-pixel corresponding to the minimum reference brightness value. With respect to the driving method according to the embodiment of the present disclosure, when the display device is driven to display an image, there may be at least one primary-color sub-pixel in each pixel of the display panel that does not need to emit light. Since the light-emitting efficiency of the mixed-color sub-pixel is higher than that of the primary-color sub-pixels, the mixed-color sub-pixel emits light instead of the primary-color sub-pixels under the same light-emitting brightness, which can effectively reduce the power consumption of the display device.

Exemplarily, it is assumed that the output brightness value of the white mixed-color sub-pixel W is LW3=LG2/Gs. Then, the driving device may determine that the brightness component of the red sub-pixel R is LW3×Rs, and may further determine that the output brightness value LR3 of the red sub-pixel R satisfies: LR3=LR2−LW3×Rs. The brightness component of the green sub-pixel G is LW3×Gs, and it can be further determined that the output brightness value LG3 of the green sub-pixel G satisfies: LG3=LG2−LW3×Gs=0. The brightness component of the blue sub-pixel B is LW3×Bs, and it can be further determined that the output brightness value LB3 of the blue sub-pixel B satisfies: LB3=LB2−LW3×Bs. Since the output brightness value of the green sub-pixel G is 0, as shown in FIG. 4, when the image is displayed, the green sub-pixel G does not need to emit light, and it may be replaced by the white mixed-color sub-pixel W to emit light. Since the white mixed-color sub-pixel W has a high light-emitting efficiency, the power consumption of the display device can be effectively reduced.

In step 209, the output brightness value of each of the sub-pixels is outputted to the source driving circuit.

Figure 5:
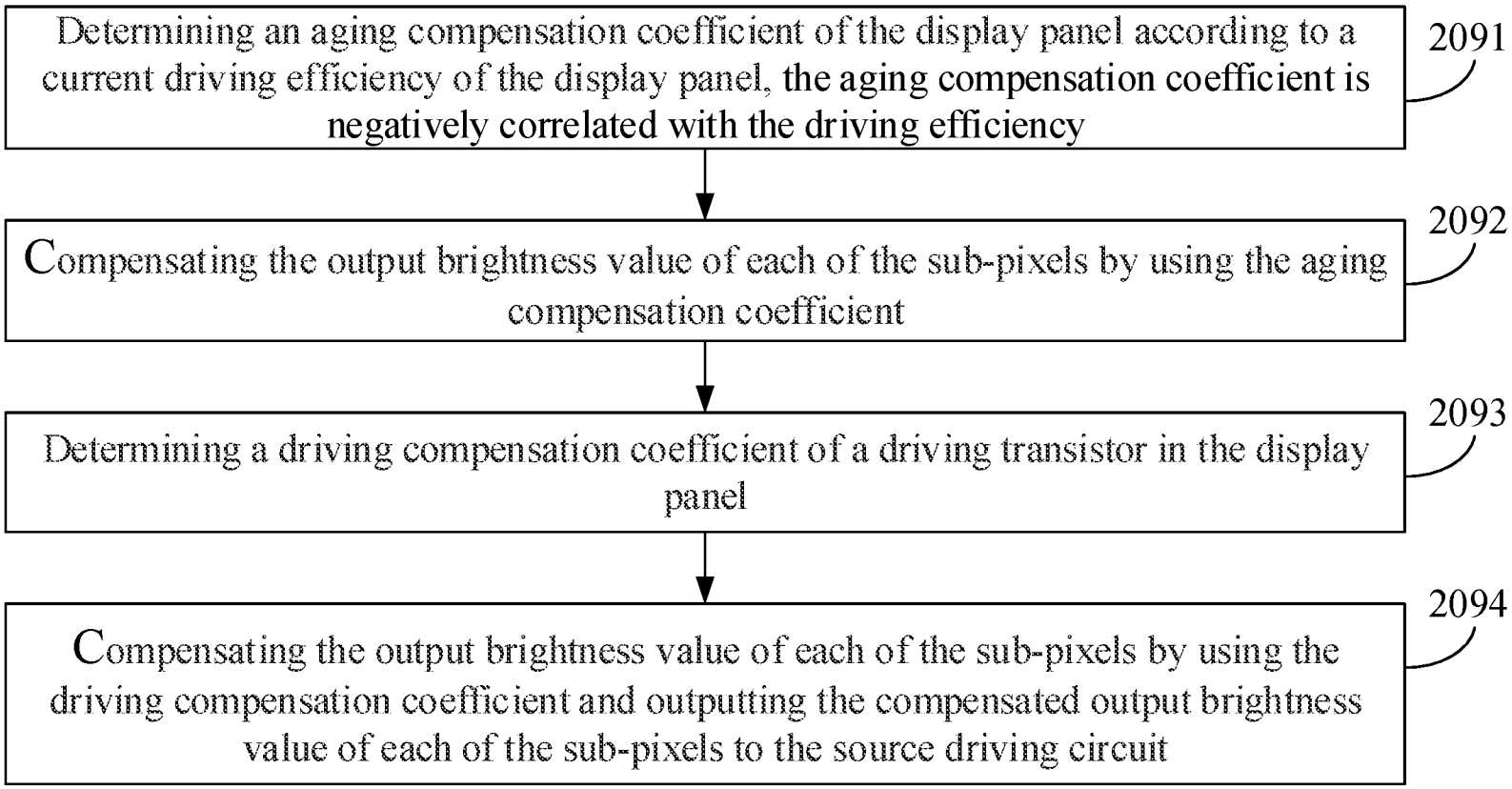
FIG. 5 is a flowchart of a method for outputting the output brightness value of each of the sub-pixels to the source driving circuit according to an embodiment of the present disclosure.

FIG. 5 is a flowchart of a method for outputting the output brightness value of each of the sub-pixels to the source driving circuit according to an embodiment of the present disclosure. Referring to FIG. 5, the method may include step 2091 to step 2094.

In step 2091, an aging compensation coefficient of the display panel is determined according to a current driving efficiency of the display panel, and the aging compensation coefficient is negatively correlated with the driving efficiency.

In the embodiment of the present disclosure, a correspondence relationship between the driving efficiency and the aging compensation coefficient of the display panel may be stored in the driving device, and the driving device may determine the aging compensation coefficient corresponding to a current driving efficiency of the display panel according to the correspondence relationship. In the correspondence relationship, the aging compensation coefficient is negatively correlated with the driving efficiency. That is, the higher the driving efficiency of the display panel is, the smaller the aging compensation coefficient is. Likewise, the aging compensation coefficient is also a number greater than or equal to 0 and less than or equal to 1.

Exemplarily, it is assumed that the correspondence relationship between the driving efficiency and the aging compensation coefficient stored in the driving device is as shown in Table 1. It can be seen from Table 1 that when the driving efficiency of the display panel is greater than or equal to 70% and less than 80%, the corresponding aging compensation coefficient is 0.9. When the driving efficiency of the display panel is greater than or equal to 90%, the corresponding aging compensation coefficient is 0.8. If the driving device detects that the current driving efficiency of the display panel is 80%, it can be determined according to the correspondence relationship shown in Table 1 that the aging compensation coefficient corresponding to the driving efficiency is 0.85.

TABLE 1

| Driving efficiency | ≤60% | [60%, 70) | [70%, 80) | [80%, 90) | ≥90% |
|---|---|---|---|---|---|
| Aging compensation coefficient | 0.99 | 0.95 | 0.9 | 0.85 | 0.8 |

In step 2092, the output brightness value of each of the sub-pixels is compensated by using the aging compensation coefficient.

Since the driving efficiency of the display device will decrease as its usage time increases, in order to prevent the change in the driving efficiency from affecting the display effect of the display device, the output brightness value of each of the sub-pixels may be compensated according to the aging compensation coefficient.

Exemplarily, it is assumed that the aging compensation coefficient is 0.85, the brightness value after the driving device compensates for the output brightness value LR3 of the red sub-pixel R is 0.85×LR3, the brightness value after the driving device compensates for the output brightness value LG3 of the green sub-pixel G is 0.85×LG3, and the brightness value after the driving device compensates for the output brightness value LB3 of the blue sub-pixel B is 0.85×LB3.

In step 2093, a driving compensation coefficient of a driving transistor in the display panel is determined.

In the embodiment of the present disclosure, a correspondence relationship between a driving parameter and the driving compensation coefficient of the driving transistor may be further stored in the driving device, and the driving device may determine the driving compensation coefficient corresponding to a current driving parameter of the driving transistor according to the correspondence relationship. The driving parameter may include a mobility of a threshold voltage of the driving transistor, and the driving compensation coefficient is positively correlated with the mobility of the threshold voltage. That is, the greater the mobility of the threshold voltage is, the greater the driving compensation coefficient is.

In step 2094, the output brightness value of each of the sub-pixels is compensated by using the driving compensation coefficient and outputted the compensated output brightness value of each of the sub-pixels to the source driving circuit.

Since the performance of the driving transistor of the display device will change as the usage time of the display device increases, for example, migration may occur on the threshold voltage of the driving transistor. In order to prevent the migration of the threshold voltage of the driving transistor from affecting the display effect of the display device, the output brightness value of each of the sub-pixels may be compensated according to the driving compensation coefficient, and then the compensated output brightness value is outputted to the source driving circuit, so that the source driving circuit may drive each of pixels of the display panel to emit light according to the output brightness value.

Alternatively, in the embodiment of the present disclosure, the driving device may not only compensate for the output brightness value according to the driving compensation coefficient, but also may detect the threshold voltage of the driving transistor in real time and compensate for the output brightness value according to the detected threshold voltage, so as to prevent the change in the threshold voltage from affecting the display uniformity of the display panel.

In the embodiment of the present disclosure, the driving device may be a separately integrated control chip in the display device, or may be integrated on a system on chip (SOC) or a graphics card of the display device, and the driving device may output the compensated output brightness value to a timing controller (TCON) of the display device, and then the compensated output brightness value is outputted to the source driving circuit by the TCON. Or, the driving device may be a TCON or is integrated in a microcontroller unit (MCU) of the TCON, and the driving device can directly output the compensated output brightness value to the source driving circuit.

As an alternative implementation, the driving device may directly output the output brightness value of each of the sub-pixels to the source driving circuit. As another alternative implementation, the driving device may also convert the output brightness value of each of the sub-pixels into display gray levels and then output to the source driving circuit.

Figure 6:
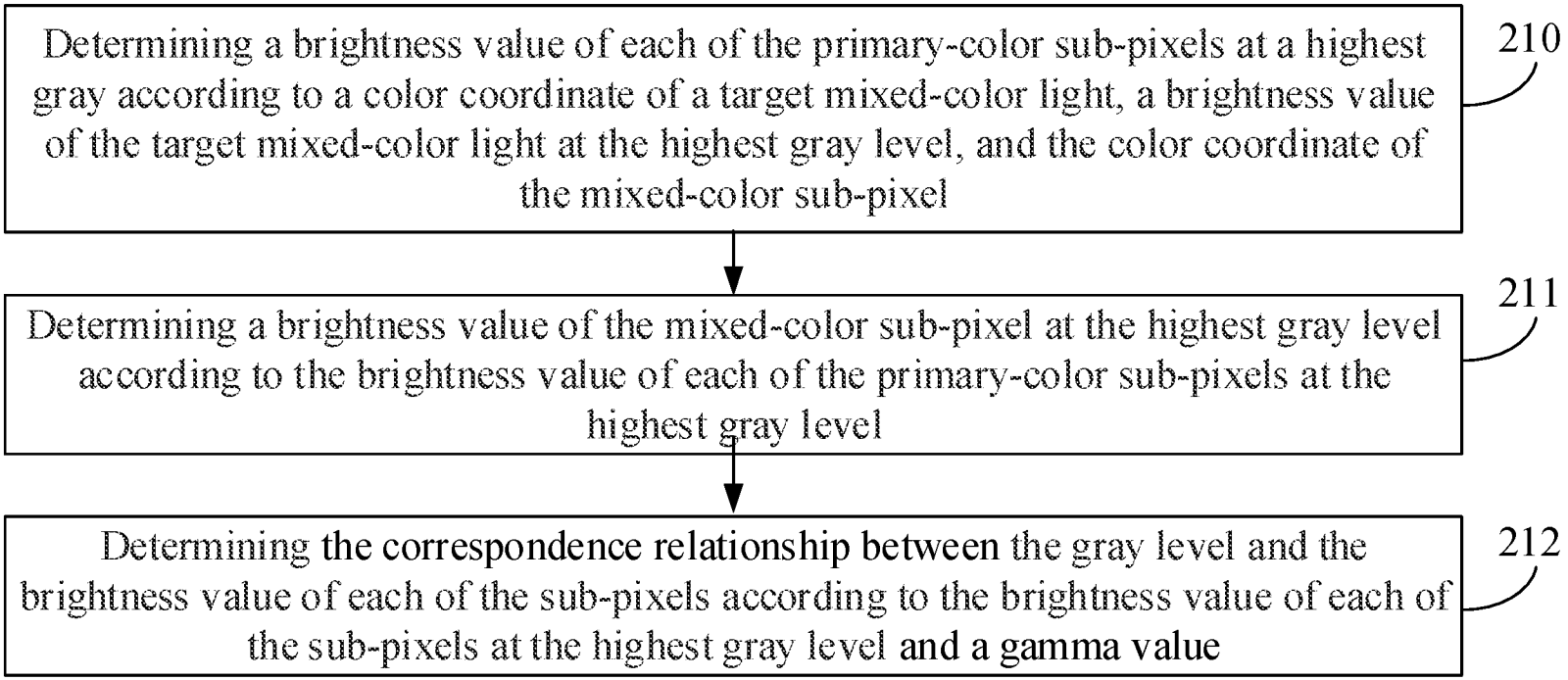
FIG. 6 is a flowchart of a method for determining a correspondence relationship between a gray level and a brightness value according to an embodiment of the present disclosure.

FIG. 6 is a flowchart of a method for determining a correspondence relationship between a gray level and a brightness value according to an embodiment of the present disclosure. Referring to FIG. 6, the method may comprise step 210 to step 212.

In step 210, a brightness value of each of the primary-color sub-pixels at a highest gray level is determined according to a color coordinate of a target mixed-color light and a brightness value of the target mixed-color light at the highest gray level, and the color coordinate of the mixed-color sub-pixel.

In the embodiment of the present disclosure, the color coordinate (X, Y, Z) of the target mixed-color light and the brightness value L of the target mixed-color light at the highest gray level may be previously stored in the driving device. The driving device may determine the brightness value of each of the primary-color sub-pixels at the highest gray level according to the actually measured color coordinate of the mixed-color sub-pixel and the color coordinate of each of the primary-color sub-pixels, and according to a color superposition theorem and a brightness superposition theorem (i.e., the brightness of the mixed-color light formed by the mixing of the light emitted by each of the primary-color sub-pixels is equal to the sum of the brightness of each of the primary-color sub-pixels.

For example, it is assumed that the color coordinate of the red sub-pixel R is (Rx, Ry, Rz), the color coordinate of the green sub-pixel G is (Gx, Gy, Gz), and the color coordinate of the blue sub-pixel B is (Bx, By, Bz), the color coordinate (Wx, Wy, Wz) of the mixed-color light formed by the mixing of the light emitted by each of the sub-pixels can satisfy:

$$Wx=(Rx+Gx+Bx)/(Rx+Gx+Bx+Ry+Gy+By+Rz+Gz+Bz);$$

$$Wy=(Ry+Gy+By)/(Rx+Gx+Bx+Ry+Gy+By+Rz+Gz+Bz);$$

$$Wz=(Rz+Gz+Bz)/(Rx+Gx+Bx+Ry+Gy+By+Rz+Gz+Bz).$$

The driving device may derive the color coordinate of each of the primary-color sub-pixels and the brightness value of each of the primary-color sub-pixels at the highest gray level when the target mixed-color light is formed by the mixing of the light emitted by each of the primary-color sub-pixels, according to the above correspondence relationship between the color coordinates and according to the brightness superposition theorem.

In step 211, a brightness value of the mixed-color sub-pixel at the highest gray level is determined according to the brightness value of each of the primary color sub-pixels at the highest gray level and a color mixing ratio corresponding to each of the primary-color sub-pixels.

In the embodiment of the present disclosure, the driving device may separately calculate a ratio of the brightness value of each of the primary-color sub-pixels at the highest gray level to the color mixing ratio corresponding thereto. Then, a ratio having a minimum value among the ratios corresponding to the primary-color sub-pixels is determined as the brightness value of the mixed-color sub-pixel at the highest gray level.

Exemplarily, it is assumed that the brightness values of the three primary-color sub-pixels of R, G, and B at the highest gray level calculated by the driving device are Rmax, Gmax, and Bmax, respectively. The driving device can then calculate that the ratio of the brightness value of the red sub-pixel R at the highest gray level to the color mixing ratio of the red sub-pixel is Rmax/Rs, the ratio of the brightness value of the green sub-pixel G at the highest gray level to the color mixing ratio of the green sub-pixel is Gmax/Gs, and the ratio of the brightness value of the blue sub-pixel B at the highest gray level to the color mixing ratio of the blue sub-pixel is Bmax/Bs. Thereafter, the driving device may determine the ratio having a minimum value among the three ratios Rmax/Rs, Gmax/Gs, and Bmax/Bs as the brightness value of the white mixed-color sub-pixel W at the highest gray level.

For example, it is assumed that the ratio having a minimum value among the three ratios Rmax/Rs, Gmax/Gs, and Bmax/Bs is Gmax/Gs, and the driving device may determine that the brightness value of the white mixed-color sub-pixel W at the highest gray level is Gmax/Gs.

In step 212, the correspondence relationship between the gray level and the brightness value of each of the sub-pixels is determined according to the brightness value of each of the sub-pixels at the highest gray level and a gamma value.

In the embodiment of the present disclosure, in the mixed-color sub-pixel and the primary-color sub-pixels in each pixel, the correspondence relationship between the gray level and the brightness value of the i-th sub-pixel may be expressed as:

$$Li=Li_max\times(Gri/Gri_max)\hat{}\gamma \qquad \text{Formula (2);}$$

wherein Li is the brightness value of the i-th sub-pixel, Li_max is the brightness value of the i-th sub-pixel at the highest gray level, Gri is the gray level of the i-th sub-pixel, and Gir_max is the highest gray level of the i-th sub-pixel, γ is the gamma value, and γ is generally 2.2. (Gri/Gri__max)^γ represents the γ power of Gri/Gri_max. The gamma value γ may be a preset value in the driving device, and may be configured before the driving device leaves the factory.

Therefore, in the above step 202, after the display device obtains the display gray level of each of the primary-color sub-pixels, the display device may convert the display gray level of each of the primary-color sub-pixels into the corresponding brightness value according to the correspondence relationship shown by Formula (2), thereby enabling white balance adjustment of the display panel.

Exemplarily, it is assumed that the display gray level of the red sub-pixel obtained by the driving device in the above step 202 is GrR, and according to the above Formula (2) the driving device may determine that the brightness value LR of the red sub-pixel is:

$$LR=R\ \max\times(GrR/GrR_max)\hat{}2$$

wherein GrR_max is the highest gray level of the red sub-pixel.

The sequence of the steps of the driving method for the display panel according to the embodiment of the present disclosure may be appropriately adjusted, and the steps may also be correspondingly increased or decreased according to the situation. For example, the step 2043 to the step 2045 may be deleted according to the situation, or the step 2091 to the step 2094 may be deleted according to the situation. That is, the driving device may directly output the output brightness value determined in step 208 to the source driving circuit. Any method that can be easily conceived by those skilled in the art within the scope of the technology disclosed in the present disclosure is intended to be included in the scope of the present disclosure, and therefore will not be described again.

In summary, with respect to the driving method for the display panel according to the embodiment of the present disclosure, after the brightness values of the primary-color sub-pixels are obtained, the brightness value of each of the primary-color sub-pixels may be compensated according to the display power consumption, so that when the display power consumption is different, the degree of compensation for the brightness value is also different, and thus the power consumption of the display device can be reasonably utilized to improve the driving flexibility and the display effect of the display panel.

Figure 7:
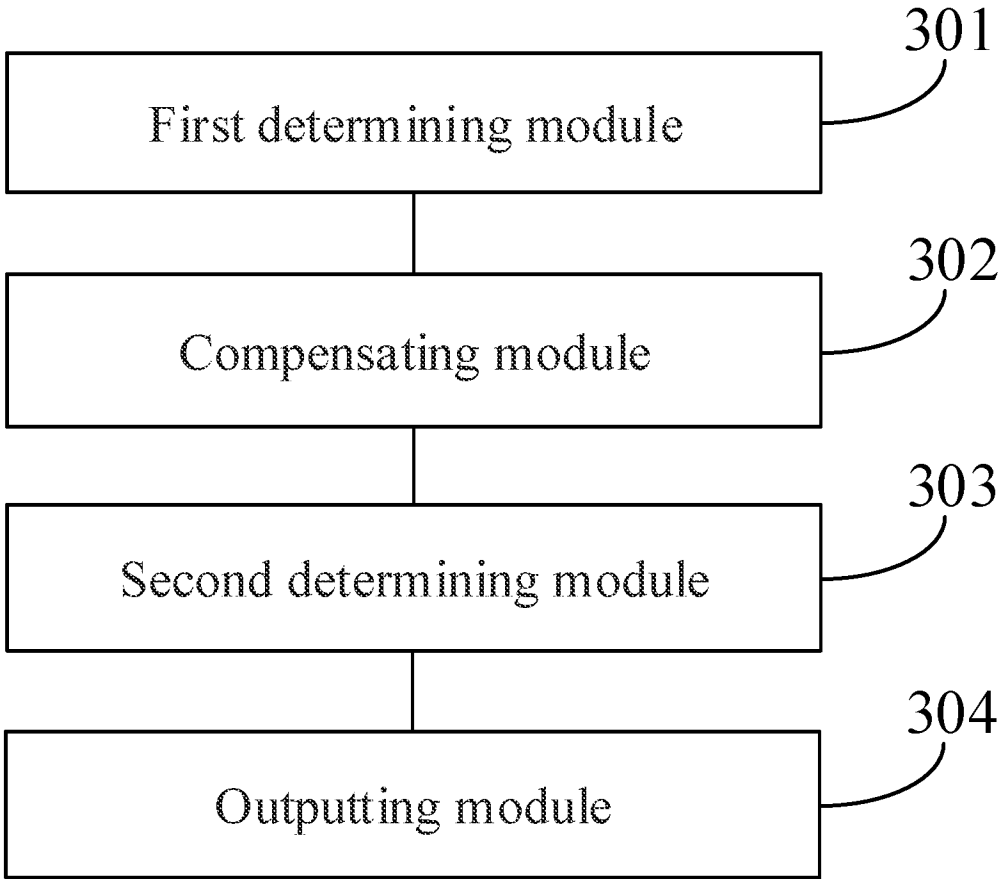
FIG. 7 is a schematic structural diagram of a driving device for a display panel according to an embodiment of the present disclosure.

FIG. 7 is a schematic structural diagram of a driving device for a display panel according to an embodiment of the present disclosure. Each pixel of the display panel comprises at least two primary-color sub-pixels of different colors and one mixed-color sub-pixel. As shown in FIG. 7, the driving device may include following modules, A first determining module 301 is used to determine display power consumption according to the obtained brightness value of each of the primary-color sub-pixels.

A compensating module 302 is used to compensate for the brightness value of each of the primary-color sub-pixels according to the display power consumption.

A second determining module 303 is used to determine an output brightness value of each of the sub-pixels according to the compensated brightness value of each of the primary-color sub-pixels and a color coordinate of each of the sub-pixels.

An outputting module 304 is used to output the output brightness value of each of the sub-pixels to a source driving circuit, wherein the output brightness value of each of the sub-pixels are used by the source driving circuit to drive the display panel to display images.

Optionally, compensating module 302 is further used to determine a power consumption gain according to the display power consumption, wherein the power consumption gain is negatively correlated with the display power consumption, and make compensation for the brightness value of each of the primary-color sub-pixels by using the power consumption gain.

Optionally, the compensating module 302 is further used to detect whether a display image is a still image according to the compensated brightness value of each of the primary-color sub-pixels; determine, when it is detected that the display image is a still image, a static gain according to the power consumption gain and a still duration of the still image, wherein the static gain is negatively correlated with the power consumption gain, and is negatively correlated with the still duration; and make compensation for the brightness value of each of the primary-color sub-pixels by using the static gain after the compensation using the power consumption gain.

Optionally, the process of detecting, by the compensating module, whether the display image is a still image comprises adding the brightness value of each of the primary-color sub-pixels in all pixels in the display image to obtain a sum of brightness of the display image; determining that the display image is a still image if the sum of brightness of the display image is equal to a sum of brightness of a previous frame image; and determining that the display image is not a still image if the sum of the brightness of the display image is not equal to the sum of the brightness of the previous frame image.

Optionally, the compensating module 302 is further used to determine a color mixing ratio corresponding to each of the primary-color sub-pixels according to the color coordinate of each of the primary-color sub-pixels and the color coordinate of the mixed-color sub-pixel, wherein the color mixing ratio corresponding to each of the primary-color sub-pixels refers to the proportion of the light having a color of the primary-color sub-pixels in the light emitted by the mixed-color sub-pixel; calculate a ratio of the compensated brightness value of each of the primary-color sub-pixels to the color mixing ratio of the primary-color sub-pixel, to obtain a reference brightness value corresponding to each of the primary-color sub-pixels; determine the minimum reference brightness value among the reference brightness values corresponding to the primary-color sub-pixels as an output brightness value of the mixed-color sub-pixel; and determine an output brightness value of each of the primary-color sub-pixels according to the output brightness value of the mixed-color sub-pixel, wherein the output brightness value of each of the primary-color sub-pixels is a difference between the compensated brightness value of the primary-color sub-pixel and the brightness component of the primary-color sub-pixel, wherein the brightness component of the primary-color sub-pixel is a product of the output brightness value of the mixed-color sub-pixel and the color mixing ratio corresponding to the primary-color sub-pixel.

Figure 8:
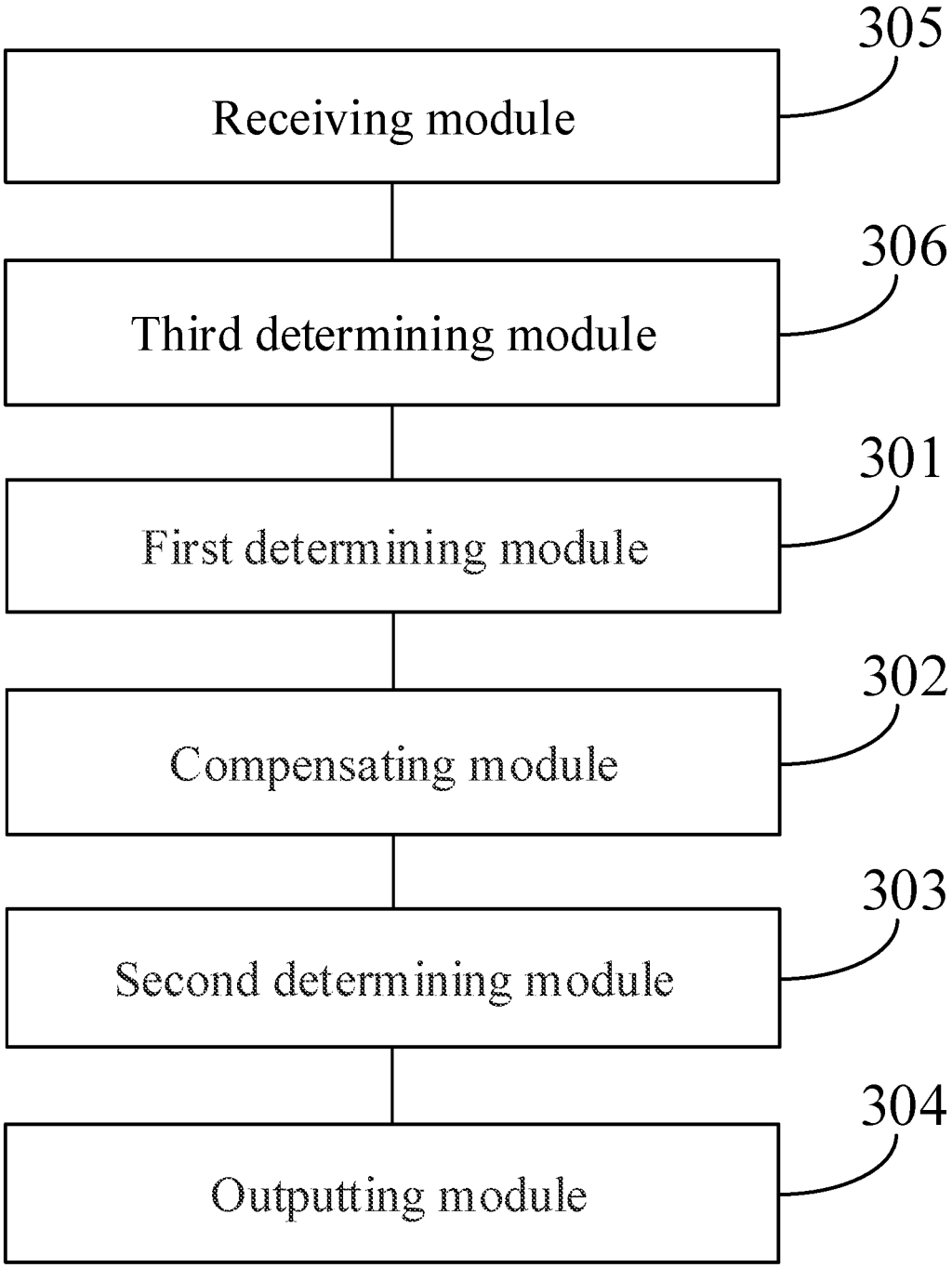
FIG. 8 is a schematic structural diagram of another driving device for a display panel according to an embodiment of the present disclosure.

Optionally, the second determining module 303 may be further used to: determine a brightness value of each of the primary-color sub-pixels at a highest gray level according to a color coordinate of a target mixed-color light, a brightness value of the target mixed-color light at the highest gray level, and the color coordinate of the mixed-color sub-pixel; determine a brightness value of the mixed-color sub-pixel at the highest gray level according to the brightness value of each of the primary-color sub-pixels at the highest gray level and a color mixing ratio corresponding to each of the primary-color sub-pixels; and determine a correspondence relationship between a gray level and a brightness value of each of the sub-pixels according to the brightness value of each of the sub-pixels at the highest gray level and a preset gamma value;

FIG. 8 is a schematic structural diagram of another driving device for a display panel according to an embodiment of the present disclosure. As shown in FIG. 8, the driving device may further include:

a receiving module 305, used to receive a display gray level of each of the primary-color sub-pixels; and a third determining module 306, used to determine a brightness value corresponding to the display gray level of each of the primary-color sub-pixels according to the correspondence relationship between the gray level and the brightness value of each of the sub-pixels.

Figure 9:
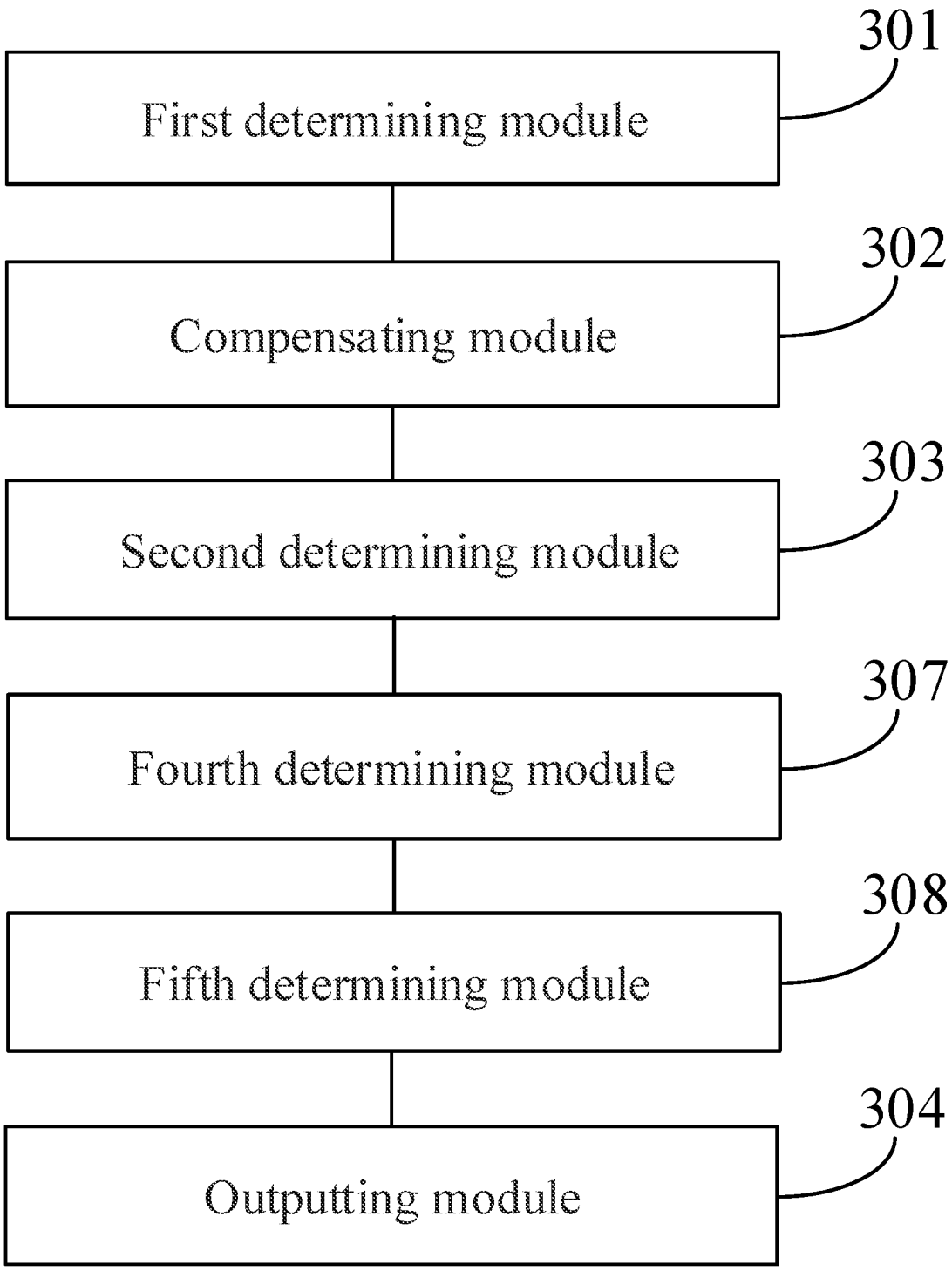
FIG. 9 is a schematic structural diagram of still another driving device for a display panel according to an embodiment of the present disclosure.

FIG. 9 is a schematic structural diagram of still another driving device for a display panel according to an embodiment of the present disclosure. As shown in FIG. 9, the driving device may further include:

a fourth determining module 307, used to determine an aging compensation coefficient of the display panel according to a current driving efficiency of the display panel, wherein the aging compensation coefficient is negatively correlated with the driving efficiency.

The outputting module 304 may be used to compensate for the output brightness value of each of the sub-pixels by using the aging compensation coefficient and output the compensated output brightness value of each of the sub-pixels to the source driving circuit.

Alternatively, as shown in FIG. 9, the driving device may further include:

a fifth determining module 308, used to determine a driving compensation coefficient of a driving transistor in the display panel.

The outputting module 304 may be used to compensate for the output brightness value of each of the sub-pixels by using the driving compensation coefficient and output the compensated output brightness value of each of the sub-pixels to the source driving circuit.

Alternatively, the fourth determining module 307 and the fifth determining module 308 may be modules independent of the outputting module 304, Or, the fourth determining module 307 and the fifth determining module 308 may be part of the outputting module 304, i.e., the fourth determining module 307 and the fifth determining module 308 may be sub-modules of the outputting module 304.

Alternatively, the display power consumption S can satisfy:

$$S = \sum_{i=1}^{n} Li - (n-1)\min(L1, \ldots, Ln);$$

wherein n is the total number of primary-color sub-pixels included in each pixel, Li is the brightness value of the i-th primary-color sub-pixel, i is a positive integer not greater than n, and min represents to get a minimum value.

In summary, with respect to the driving device for the display panel according to the embodiment of the present disclosure, the driving device may, after obtaining the brightness value of each of the primary-color sub-pixels, compensate for the brightness value of each of the primary-color sub-pixels according to the display power consumption, so that when the display power consumption is different, the degree of compensation for the brightness value is also different, and thus the power consumption of the display device can be reasonably utilized to improve the driving flexibility and the display effect of the display panel.

Those skilled in the art will clearly appreciate that, for convenience and brevity of the description, the specific working process of the driving device and the modules described above can refer to the corresponding process in the foregoing method embodiments, which will not be described again herein.

Figure 10:
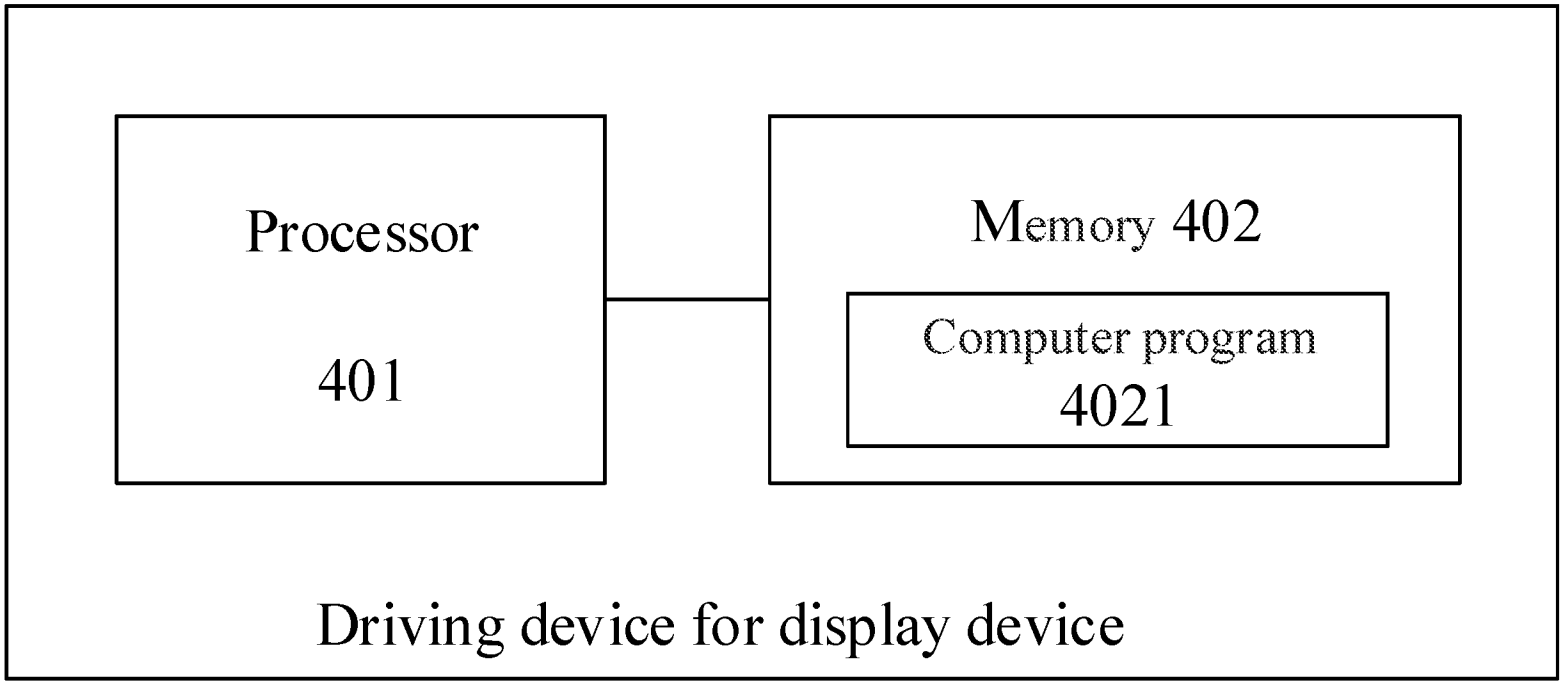
FIG. 10 is a schematic structural diagram of yet another driving device for a display panel according to an embodiment of the present disclosure.

FIG. 10 is a schematic structural diagram of yet another driving device for a display panel according to an embodiment of the present disclosure. As shown in FIG. 10, the driving device may include: a processor 401, a memory 402, and a computer program 4021 stored on the memory 402 and capable of running on the processor 401. The processor 401 may be a processing circuit or a processing unit. When the processor 401 executes the computer program 4021, the driving method for the display panel according to the foregoing method embodiments can be implemented.

In the embodiment of the present disclosure, the driving device may be a separately integrated control chip in the display device, or may be integrated on the SOC or the graphics card of the display device; or the driving device may be a TCON or integrated in a MCU of the TCON.

An embodiment of the present disclosure provides a computer readable storage medium having instructions stored therein, wherein the stored computer program is capable of implementing the driving method for the display panel in the above embodiments when running on a computer.

An embodiment of the present disclosure provides a display device that may include the driving device as shown in any of FIGS. 7 to 10 and a display panel. The display device may be any product or component having a display function such as a liquid crystal panel, an electronic paper, an OLED panel, an AMOLED panel, a mobile phone, a tablet computer, a television, a display, a notebook computer, a digital photo frame, a navigator, and the like.

The foregoing descriptions are only optional embodiments of the present disclosure, and are not intended to limit the present disclosure. Within the spirit and principles of the disclosure, any modifications, equivalent substitutions, improvements, etc., are within the protection scope of the appended claims of the present disclosure.

The invention claimed is:

1. A driving method for a display panel, wherein each pixel of the display panel comprises at least two primary-color sub-pixels of different colors and one mixed-color sub-pixel, and the driving method comprises:

determining display power consumption according to an obtained brightness value of each of the primary-color sub-pixels;

compensating for the brightness value of each of the primary-color sub-pixels according to the display power consumption;

determining an output brightness value of each of the sub-pixels according to the compensated brightness value of each of the primary-color sub-pixels and a color coordinate of each of the sub-pixels; and outputting the output brightness value of each of the sub-pixels to a source driving circuit, wherein the output brightness value of each of the sub-pixels are used by the source driving circuit to drive the display panel to display images; and wherein determining the output brightness value of each of the sub-pixels according to the compensated brightness value of each of the primary-color sub-pixels and the color coordinate of each of the sub-pixels comprises:

determining a color mixing ratio corresponding to each of the primary-color subpixels according to a color coordinate of each of the primary-color sub-pixels and a color coordinate of the mixed-color sub-pixel, wherein the color mixing ratio corresponding to each of the primary-color sub-pixels refers to the proportion of light having a color of the primary-color sub-pixel in light emitted by the mixed-color sub-pixel;

calculating a ratio of the compensated brightness value of each of the primary color sub-pixels to the color mixing ratio of the primary-color sub-pixel, to obtain a reference brightness value corresponding to each of the primary-color sub-pixels;

determining the minimum reference brightness value among the reference brightness values corresponding to the primary-color sub-pixels as an output brightness value of the mixed-color sub-pixel; and determining an output brightness value of each of the primary-color sub-pixels according to the output brightness value of the mixed-color sub-pixel, wherein the output brightness value of each of the primary-color sub-pixels is a difference between the compensated brightness value of the primary-color sub-pixel and the brightness component of the primary-color sub-pixel, wherein the brightness component of the primary-color sub-pixel is a product of the output brightness value of the mixed-color sub-pixel and the color mixing ratio corresponding to the primary-color sub-pixel.

2. The driving method according to claim 1, wherein compensating for the brightness value of each of the primary-color sub-pixels according to the display power consumption comprises:

determining a power consumption gain according to the display power consumption, wherein the power consumption gain is negatively correlated with the display power consumption; and making compensation for the brightness value of each of the primary-color subpixels by using the power consumption gain.

3. The driving method according to claim 2, wherein after making the compensation for the brightness value of each of the primary-color sub-pixels by using the power consumption gain, the driving method further comprises:

detecting whether a display image is a still image;

determining, if it is detected that the display image is a still image, a static gain according to the power consumption gain and a still duration of the still image, wherein the static gain is negatively correlated with the power consumption gain, and is negatively correlated with the still duration; and making compensation for the brightness value of each of the primary-color subpixels by using the static gain after the compensation using the power consumption gain.

4. The driving method according to claim 3, wherein detecting whether the display image is a still image comprises:

adding the brightness value of each of the primary-color sub-pixels in all pixels in the display image to obtain a sum of brightness of the display image;

determining that the display image is a still image if the sum of brightness of the display image is equal to a sum of brightness of a previous frame image; and determining that the display image is not a still image if the sum of the brightness of the display image is not equal to the sum of brightness of the previous frame image.

5. The driving method according to claim 1, further comprises:

determining a brightness value of each of the primary-color sub-pixels at a highest gray level according to a color coordinate of a target mixed-color light, a brightness value of the target mixed-color light at the highest gray level, and the color coordinate of the mixed-color sub-pixel;

determining a brightness value of the mixed-color sub-pixel at the highest gray level according to the brightness value of each of the primary-color sub-pixels at the highest gray level and a color mixing ratio corresponding to each of the primary-color sub-pixels, wherein the color mixing ratio corresponding to each of the primary-color sub-pixels refers to the proportion of light having a color of the primary-color sub-pixel in light emitted by the mixed-color sub-pixel; and determining a correspondence relationship between a gray level and a brightness value of each of the sub-pixels according to the brightness value of each of the sub-pixels at the highest gray level and a gamma value;

before determining the display power consumption according to the obtained brightness value of each of the primary-color sub-pixels, the driving method further comprises:

receiving a display gray level of each of the primary-color sub-pixels; and determining the brightness value corresponding to the display gray level of each of the primary-color sub-pixels according to the correspondence relationship between the gray level and the brightness value of each of the sub-pixels.

6. The driving method according to claim 1, wherein outputting the output brightness value of each of the sub-pixels to the source driving circuit comprises:

determining an aging compensation coefficient of the display panel according to a current driving efficiency of the display panel, wherein the aging compensation coefficient is negatively correlated with the driving efficiency; and compensating for the output brightness value of each of the sub-pixels by using the aging compensation coefficient, and outputting the compensated output brightness value of each of the sub-pixels to the source driving circuit.

7. The driving method according to claim 1, wherein outputting the output brightness value of each of the sub-pixels to the source driving circuit comprises:

determining a driving compensation coefficient of a driving transistor in the display panel; and compensating for the output brightness value of each of the sub-pixels by using the driving compensation coefficient, and output the compensated output brightness value of each of the sub-pixels to the source driving circuit.

8. The method according to claim 1, wherein the display power consumption S satisfies:

$$S = \sum_{i=1}^{n} Li - (n-1)\min(L1, \ldots, Ln);$$

wherein n is the total number of primary-color sub-pixels included in each pixel, Li is the brightness value of the i-th primary-color sub-pixel, i is a positive integer not greater than n, and min represents to get a minimum value.

9. A driving device for a display panel, wherein each pixel of the display panel comprises at least two primary-color sub-pixels of different colors and one mixed color sub-pixel, and the driving device comprises: a processor, a memory, and a computer program stored on the memory and capable of running on the processor, wherein the processor implements following process when executing the computer program:

determining display power consumption according to the obtained brightness value of each of the primary-color sub-pixels;

compensating for the brightness value of each of the primary-color sub-pixels according to the display power consumption;

determining an output brightness value of each of the sub-pixels according to the compensated brightness value of each of the primary-color sub-pixels and a color coordinate of each of the sub-pixels; and outputting the output brightness value of each of the sub-pixels to a source driving circuit, wherein the output brightness value of each of the sub-pixels are used by the source driving circuit to drive the display panel to display images; and wherein determining the output brightness value of each of the sub-pixels according to the compensated brightness value of each of the primary-color sub-pixels and the color coordinate of each of the sub-pixels comprises:

determining a color mixing ratio corresponding to each of the primary-color subpixels according to the color coordinate of each of the primary-color sub-pixels and the color coordinate of the mixed-color sub-pixel, wherein the color mixing ratio corresponding to each of the primary-color sub-pixels refers to the proportion of light having a color of the primary-color sub-pixel in light emitted by the mixed-color subpixel;

calculating a ratio of the compensated brightness value of each of the primary color sub-pixels to the color mixing ratio of the primary-color sub-pixel, to obtain a reference brightness value corresponding to each of the primary-color sub-pixels;

determining the minimum reference brightness value among the reference brightness values corresponding to the primary-color sub-pixels as an output brightness value of the mixed-color sub-pixel; and determining an output brightness value of each of the primary-color sub-pixels according to the output brightness value of the mixed-color sub-pixel, wherein the output brightness value of each of the primary-color sub-pixels is a difference between the compensated brightness value of the primary-color sub-pixel and the brightness component of the primary-color sub-pixel, wherein the brightness component of the primary-color sub-pixel is a product of the output brightness value of the mixed-color sub-pixel and the color mixing ratio corresponding to the primary-color sub-pixel.

10. The driving device according to claim 9, wherein compensating for the brightness value of each of the primary-color sub-pixels according to the display power consumption comprises:

determining a power consumption gain according to the display power consumption, wherein the power consumption gain is negatively correlated with the display power consumption; and making compensation for the brightness value of each of the primary-color subpixels by using the power consumption gain.

11. The driving device according to claim 10, wherein the processor further implements following process when executing the computer program:

detecting whether a display image is a still image;

determining, if it is detected that the display image is a still image, a static gain according to the power consumption gain and a still duration of the still image, wherein the static gain is negatively correlated with the power consumption gain, and is negatively correlated with the still duration; and making compensation for the brightness value of each of the primary-color subpixels by using the static gain after the compensation using the power consumption gain.

12. The driving device according to claim 11, wherein detecting whether a display image is a still image comprises:

adding the brightness value of each of the primary-color sub-pixels in all pixels in the display image to obtain a sum of brightness of the display image;

determining that the display image is a still image if the sum of brightness of the display image is equal to a sum of brightness of a previous frame image; and determining that the display image is not a still image if the sum of the brightness of the display image is not equal to the sum of the brightness of the previous frame image.

13. The driving device according to claim 9, wherein the processor further implements following process when executing the computer program:

determining a brightness value of each of the primary-color sub-pixels at a highest gray level according to a color coordinate of a target mixed-color light, a brightness value of the target mixed-color light at the highest gray level, and the color coordinate of the mixed-color sub-pixel;

determining a brightness value of the mixed-color sub-pixel at the highest gray level according to the brightness value of each of the primary-color sub-pixels at the highest gray level and a color mixing ratio corresponding to each of the primary-color sub-pixels, wherein the color mixing ratio corresponding to each of the primary-color sub-pixels refers to the proportion of light having a color of the primary-color sub-pixel in light emitted by the mixed-color sub-pixel; and determining a correspondence relationship between a gray level and a brightness value of each of the sub-pixels according to the brightness value of each of the sub-pixels at the highest gray level and a gamma value;

the processor further implements following process when executing the computer program:

receiving a display gray level of each of the primary-color sub-pixels; and determining a brightness value corresponding to the display gray level of each of the primary-color sub-pixels according to the correspondence relationship between the gray level and the brightness value of each of the sub-pixels.

14. The driving device according to claim 9, wherein outputting the output brightness value of each of the sub-pixels to the source driving circuit comprises:

determining an aging compensation coefficient of the display panel according to a current driving efficiency of the display panel, wherein the aging compensation coefficient is negatively correlated with the driving efficiency; and compensating for the output brightness value of each of the sub-pixels by using the aging compensation coefficient, and output the compensated output brightness value of each of the sub-pixels to the source driving circuit.

15. The driving device according to claim 9, wherein outputting the output brightness value of each of the sub-pixels to the source driving circuit comprises:

determining a driving compensation coefficient of a driving transistor in the display panel; and compensating for the output brightness value of each of the sub-pixels by using the driving compensation coefficient, and output the compensated output brightness value of each of the sub-pixels to the source driving circuit.

16. A display device comprising: a display panel, and a driving device for the display panel, wherein each pixel of the display panel comprises at least two primary-color sub-pixels of different colors and one mixed-color sub-pixel, and the driving device comprises: a processor, a memory, and a computer program stored on the memory and capable of running on the processor, wherein the processor implements following process when executing the computer program:

determining display power consumption according to the obtained brightness value of each of the primary-color sub-pixels;

compensating for the brightness value of each of the primary-color sub-pixels according to the display power consumption;

determining an output brightness value of each of the sub-pixels according to the compensated brightness value of each of the primary-color sub-pixels and a color coordinate of each of the sub-pixels; and outputting the output brightness value of each of the sub-pixels to a source driving circuit, wherein the output brightness value of each of the sub-pixels are used by the source driving circuit to drive the display panel to display images; and wherein determining the output brightness value of each of the sub-pixels according to the compensated brightness value of each of the primary-color sub-pixels and the color coordinate of each of the sub-pixels comprises:

determining a color mixing ratio corresponding to each of the primary-color subpixels according to the color coordinate of each of the primary-color sub-pixels and the color coordinate of the mixed-color sub-pixel, wherein the color mixing ratio corresponding to each of the primary-color sub-pixels refers to the proportion of light having a color of the primary-color sub-pixel in light emitted by the mixed-color subpixel;

calculating a ratio of the compensated brightness value of each of the primary color sub-pixels to the color mixing ratio of the primary-color sub-pixel, to obtain a reference brightness value corresponding to each of the primary-color sub-pixels;

determining the minimum reference brightness value among the reference brightness values corresponding to the primary-color sub-pixels as an output brightness value of the mixed-color sub-pixel; and determining an output brightness value of each of the primary-color sub-pixels according to the output brightness value of the mixed-color sub-pixel, wherein the output brightness value of each of the primary-color sub-pixels is a difference between the compensated brightness value of the primary-color sub-pixel and the brightness component of the primary-color sub-pixel, wherein the brightness component of the primary-color sub-pixel is a product of the output brightness value of the mixed-color sub-pixel and the color mixing ratio corresponding to the primary-color sub-pixel.

17. A non-transitory computer readable storage medium having instructions stored therein, wherein the stored computer program is capable of implementing the driving method for the display panel according to claim 9 when running on a computer.

18. The driving device according to claim 9, wherein the display power consumption S satisfies:

$$S = \sum_{i=1}^{n} Li - (n-1)\min(L1, \ldots, Ln);$$

wherein n is the total number of primary-color sub-pixels included in each pixel, Li is the brightness value of the i-th primary-color sub-pixel, i is a positive integer not greater than n, and min represents to get a minimum value.

* * * * *